US010897085B2

(12) United States Patent
Hansson et al.

(10) Patent No.: US 10,897,085 B2
(45) Date of Patent: Jan. 19, 2021

(54) ANTENNA AND ANTENNA SYSTEM

(71) Applicant: Smarteq Wireless Aktiebolag, Kista (SE)

(72) Inventors: Erika Hansson, Stockholm (SE); Mattias Hellgren, Åkersberga (SE); Johan Sjöberg, Sollentuna (SE); Yuan Xu, Sollentuna (SE)

(73) Assignee: SMARTEQ WIRELESS AKTIEBOLAG, Kista (SE)

( * ) Notice: Subject to any disclaimer, the term of this patent is extended or adjusted under 35 U.S.C. 154(b) by 0 days.

(21) Appl. No.: 16/583,961

(22) Filed: Sep. 26, 2019

(65) Prior Publication Data

US 2020/0119450 A1 Apr. 16, 2020

(30) Foreign Application Priority Data

Oct. 15, 2018 (SE) ..... 1851260

(51) Int. Cl.
*H01Q 1/32* (2006.01)
*H01Q 9/04* (2006.01)
(Continued)

(52) U.S. Cl.
CPC ..... *H01Q 9/0414* (2013.01); *H01Q 1/3233* (2013.01); *H01Q 1/3283* (2013.01);
(Continued)

(58) Field of Classification Search
CPC ..... H01Q 1/32; H01Q 1/3233; H01Q 1/3283; H01Q 9/0407; H01Q 9/0414; H01Q 19/10; H01Q 21/205; H01Q 21/29; H01Q 25/005
See application file for complete search history.

(56) References Cited

U.S. PATENT DOCUMENTS 4,922,259 A * 5/1990 Hall et al. ..... H01Q 1/38 343/700 MS
7,554,489 B2 6/2009 Tsai et al.
(Continued)

FOREIGN PATENT DOCUMENTS

EP 2 833 479 A1 2/2015
FR 2 740 500 A1 4/1997
(Continued)

OTHER PUBLICATIONS

Swedish Search Report and English translation thereof, dated Apr. 17, 2019 issued in Swedish Application No. 1851260-8 consisting of 31 pages.
(Continued)

*Primary Examiner* — Hoang V Nguyen
(74) *Attorney, Agent, or Firm* — Christopher & Weisberg, P.A.

(57) ABSTRACT

An antenna for a vehicle. The antenna has an omni-directional radiation pattern and is configured for V2X communication. An x-y plane is defined as the horizontal plane in relation to the vehicle, an x-z plane is defined as a plane that is parallel to a side of the vehicle to which the antenna is positioned, and a y-z plane is defined as an elevation plane in relation to the vehicle. The antenna includes a first patch antenna and a second patch antenna and a reflector, and a feed network and power divider. The first patch antenna is aimed in a first direction along the x-axis. The second patch antenna is aimed in a second and opposite direction along the x-axis, and the reflector is positioned in a plane that is parallel to the x-z plane.

23 Claims, 3 Drawing Sheets

(51) Int. Cl.
*H01Q 21/20* (2006.01)
*H01Q 1/42* (2006.01)
*H01Q 19/10* (2006.01)

(52) U.S. Cl.
CPC ..... *H01Q 1/42* (2013.01); *H01Q 19/10* (2013.01); *H01Q 21/205* (2013.01)

(56) References Cited

U.S. PATENT DOCUMENTS

| | | | | |
|---|---|---|---|---|
| 2013/0178170 | A1 | 7/2013 | Schraebler Sighard et al. | |
| 2017/0054204 | A1* | 2/2017 | Changalvala ..... | H01Q 1/2291 |
| 2017/0117619 | A1* | 4/2017 | Kim ..... | H01Q 1/3275 |

FOREIGN PATENT DOCUMENTS

| | | | |
|---|---|---|---|
| WO | 2012/084844 | A2 | 6/2012 |
| WO | 2017/205551 | A1 | 11/2017 |

OTHER PUBLICATIONS

M. Ibambe Gatsinzi et al., "Study of 5.8 GHz Frequency Band Patch Antenna Integrated into a Vehicle for Automotive DSRC Applications"; International Conference on Electromagnetics in Advanced Applications 2007 IEEE, Piscataway, NJ; pp. 548-551; consisting of 4 pages.

* cited by examiner

ANTENNA AND ANTENNA SYSTEM

CROSS-REFERENCE TO RELATED APPLICATION

This Application is related to and claims priority to Swedish Application No. 1851260-8, filed Oct. 15, 2018, the entire contents of which is incorporated by reference.

TECHNICAL FIELD

The present invention relates to an antenna for a vehicle, with an omni-directional radiation pattern and being adapted to V2X communication, and an antenna system for a vehicle adapted to V2X communication, wherein the system comprises at least one first and one second inventive antenna.

BACKGROUND

V2X technologies, such as vehicle-to-vehicle (V2V) and vehicle-to-infrastructure (V2I) communications, can be used to improve collision avoidance, and will enhance traffic efficiency by providing warnings for upcoming traffic congestions, proposing alternative routes and ensuring eco-friendly driving etc.

Since this technology often use high carrier frequency, e.g. in the licensed ITS band of 5.9 GHz (5.85-5.925 GHz) according to the ITS-G5 standard, it requires a highly reliable and performed antenna. Furthermore, the antenna placement has significant impact on quality of the data transmission.

A traditional antenna is often be a dipole or a monopole antenna. Gain requirements often result in a relatively large antenna, or the use of an antenna array. When size is a problem a patch antenna can be used, which provides a higher gain, further reach and a lower profile compared with the traditional rod antenna. The antenna is often positioned on top of the vehicle where the vehicle itself will not interfere with desired radiation pattern of the antenna.

The invention is mainly focusing on vehicles where specific problems occur due to their size and shape, however, it should be understood that the invention can be easily applied to any kind of vehicles or objects of interest.

For vehicle communications it is important that used antennas are located so that they provide the best possible conditions for a clear "light-of-sight" to other vehicles or objects in front of, or behind, the vehicle regardless of the type of vehicle, such as with vehicles with irregular body shape and/or vehicles with a large trailer and with vehicles in specific situations where vehicle communication is crucial such as during platooning.

Publication EP 2 833 479 A1 shows an antenna system for a vehicle that assures both forward and backward communication for the vehicle. For that, the antenna system comprises an arrangement formed by two antenna devices, one specifically designed for radiating in a first direction of radiation, and the other, for radiating in a second direction of radiation, being the second direction of radiation an opposing direction to the first direction of radiation. The antenna system radiation pattern provides an omni-directional coverage. The disclosed antenna is a dipole antenna positioned on a ground plane to get a radiation direction. It is adapted to be mounted on top of a vehicle.

Publication U.S. Pat. No. 7,554,489 B2 shows an inclined dipole antenna concealed within a hull which is able to form an omni-directional radiation pattern.

Publication WO 2017/205551 A1 shows antennas (patch or slot antennas) used for V2X communication, and how the antennas can be placed on the front windshield, rear windshield or on a side window of a vehicle.

Publication "Study of a 5.8 GHz frequency band patch antenna integrated into a vehicle for automotive DSRC applications" by Gatsinzi M I, Jouvie F, Bunion X, and Azoulay A from 2007 International Conference on Electromagnetics in Advanced Applications 2007 IEEE Piscataway, N.J., USA, 548-551, shows a patch antenna integrated into a vehicle for automotive DSRC applications. The publication relates to a tool for simulation of a conventional patch antenna array when mounted on a car.

SUMMARY

Problems

It is a technical problem to provide an antenna with an omni-directional radiation pattern, and it is a specific technical problem to provide an antenna system that provides a bi-omni-directional horizontal radiation pattern for a vehicle.

When a vehicle for some reason cannot have the antenna on top of the vehicle, such as vehicles without a top where the antenna can be mounted, emergency vehicles or other vehicles where equipment on top of the vehicle will disturb the radiation pattern of the antenna, vehicles with complex or irregular body shapes that will disturb the radiation pattern of the vehicle, and/or vehicles with trailers that will disturb the radiation pattern of the vehicle, it is a problem to provide an antenna solution for V2X communication. The top of a passenger car is not flat but often rounded why the horizontal plane of a radiation pattern for a low profile antenna located on the front or rear part of the top of a passenger car is disturbed by the rounded profile of the car top.

Previously mentioned publication WO 2017/205551 A1 shows that the antenna can be mounted on the side window of a vehicle, but does not mention any solution to specific problems of antenna design to achieve desired radiation patterns for a side mounted antenna.

Previously mentioned publication U.S. Pat. No. 7,554,489 B2 shows a dipole antenna adapted to be mounted on top of the vehicle, where the radiation pattern in the horizontal plane will be disturbed by the vehicle if mounted on the side of the vehicle.

Solution

With the purpose of solving one or several of the above problems, and on the basis of prior art such as it has been shown above and the indicated technical field, the present invention proposes an antenna, where an x-y plane is defined as the horizontal plane in relation to the vehicle, an x-z plane is defined as a plane that is parallel to a side of the vehicle to which the antenna is positioned, and an y-z plane is defined as an elevation plane in relation to the vehicle.

The present invention specifically teaches that an antenna adapted to provide a radiation pattern of substantially a half circle in the horizontal plane and a radiation pattern of substantially a sector in the elevation plane of the vehicle is achieved through an antenna that comprises a first patch antenna, a feed network and power divider, a second patch antenna and a reflector, where the first patch antenna is aimed in a first direction along the x-axis, that the second patch antenna is aimed in a second and opposite direction along the x-axis, and that the reflector is positioned in a plane that is parallel to the x-z plane.

It is proposed that the reflector is adapted to control the radiation pattern orientation of the antenna through the control of the radiation pattern orientations for the first and second patch antenna.

With the purpose of providing a high gain broad band antenna it is proposed that the first and second patch antenna is a direct probe feed patch antenna.

It is proposed that a first electrically conductive structure is used to form the first and second patch antenna, and that a second electrically conductive structure is used to form the feed network and power divider. Different electrically conductive structures can be used, such as a sheet metal or a printed circuit board (PCB), and these can be chosen independently from each other. It is also possible that discrete components are used to form the power divider regardless of what structure that is used to form the feed network.

A very compact and cost effective embodiment of an inventive antenna would be an antenna which is formed in a multi layered PCB, where:

- a first patch radiator belonging to the first patch antenna is formed in a first electrically conductive layer in the multi layered PCB,
- a first ground plane belonging to the first patch antenna is formed in a second electrically conductive layer in the multi layered PCB,
- the feed network and power divider is formed in a third electrically conductive layer in the multi layered PCB,
- a second ground plane belonging to the second patch antenna is formed in a fourth electrically conductive layer in the multi layered PCB,
- a second patch radiator belonging to the second patch antenna is formed in a fifth electrically conductive layer in the multi layered PCB, and
- each electrically conductive layer is separated by a substrate in the multi layered PCB.

In the following, the first and second electrically conductive structure will be exemplified by a PCB, and according to one possible design for a direct probe feed patch antenna it is proposed that the PCB with its feed network is positioned parallel to and between the first and second patch antenna, and that the power divider is a 3 dB in-phase microstrip power divider designed to combine the first and second patch antenna.

It is also proposed that a low loss dielectric material with a thickness adapted to its DK value, such as Rogers RO4350 with DK=3.656, DF=0.0037 and thickness of 0.76 or 1.5 mm, is used as a substrate for the feed network and patch antennas.

Proposed dimensions for the antenna components are

- that the first and second patch antenna has a circular patch radiator with a rectangular ground plane,
- that the size of the ground plane is typically $\lambda/2\times\lambda/2\times0.76$ mm,
- that the metal reflector has a diameter of typically 0.65 to $0.75\lambda$,
- that the reflector is positioned at a distance of 0.3 to $0.4\lambda$ from the edge of the first and second patch antenna,
- that the antenna feed of the first patch antenna is placed on the −y axis, and
- that the antenna feed of the second patch antenna is placed on the +y axis, in order to provide patch antennas in phase on the Phi=90 plane, and so that the reflector positioned in the x-z plane will not affect the phase.

It should be understood that the shape of the patch, ground plane or reflector can be chosen differently from what is proposed in this embodiment, where these shapes can be circular, rectangular or oval depending on design, and the invention is not limited to shapes and dimensions shown in this proposed embodiment.

It should also be understood that the patch antenna can be based on a different feed structure such as a co-planar strip, proximity-coupled or aperture-coupled.

With the purpose of getting an antenna with a higher gain it is proposed that the patch antenna is an antenna array or a stacked patch antenna.

It should be understood that parameters regarding design of the antenna, such as

- antenna feed probe location(s),
- divider dimensions,
- antenna distance to feed network locations,
- reflector size and distance to antenna element(s), are carefully designed to eliminate any kind of mismatching and phase errors.

The inventive antenna can be adapted to function in the frequency range of 5850 to 5925 MHz, and the antenna can be adapted to provide an antenna gain in the range of 2 dBi to 5 dBi with an average of 3.5 dBi in the horizontal plane, or bi-omni directions, and VSWR: <2.0:1.

The present invention also relates to an antenna system for a vehicle adapted to V2X communication, and with the purpose of providing a system with a bi-omni-directional radiation pattern it is proposed that the system comprises at least a first and a second inventive antenna, where the first antenna is positioned at an opposite position to the second antenna on the vehicle, where the y-axis of the first antenna is directed in a first direction, and where the y-axis of the second antenna is directed in a second direction opposite to said first direction.

The positioning of the first and second antenna can be adapted to the form or shape of the vehicle.

One proposed embodiment teaches that the first and second antenna are positioned on the sides of the vehicle, where the first direction of respective first patch antenna is the forward direction of the vehicle, and the second direction of respective second patch antenna is the backward direction of the vehicle.

With the purpose of providing a full coverage of for the radiation pattern of the antenna system around the vehicle it is proposed that the antenna system may comprise at least one third antenna positioned in the front of the vehicle, where the first direction of the first patch antenna belonging to the third antenna is the right direction of the vehicle, and the second direction of the second patch antenna belonging to the third antenna is the left direction of the vehicle.

It is also possible that the antenna system comprises at least one fourth antenna positioned in the back of the vehicle, where the first direction of the first patch antenna belonging to the fourth antenna is the right direction of the vehicle, and the second direction of the second patch antenna belonging to the fourth antenna is the left direction of the vehicle.

Depending on shape and form on the vehicle another possible embodiment of the present invention teaches that the first and second antenna are positioned in the front and back of the vehicle, where the first direction of respective first patch antenna is the right direction of the vehicle, and that the second direction of respective second patch antenna is the left direction of the vehicle.

With the purpose of providing clear light-of-sight from the vehicle to other vehicles or objects around the vehicle it is proposed that the antenna system comprises mechanical support for an antenna, and that the mechanical support extends from the vehicle to position the supported antenna in a clear light-of-sight to other objects or vehicles.

It is also proposed that a mechanical and environmental protection is provided for any antenna that require such protection by means of a radome for each such antenna to protect and enclose the same.

Advantages

The advantages that foremost may be associated with an antenna and an antenna system according to the present invention are that the invention enables the design of antenna systems for vehicles where an omni-directional radiation pattern, and specifically a bi-omni-directional horizontal radiation pattern, is available for the vehicle.

The present invention is specifically designed to provide this radiation pattern for vehicle that cannot have the antenna on top of the vehicle, such as excavators, bulldozers, road maintenance vehicles and other vehicles without a top where the antenna can be mounted, vehicles with wind deflectors or beacon lights, emergency vehicles or other vehicles where equipment on top of the vehicle will disturb the radiation pattern of the antenna or prohibit the positioning of an antenna on top of the vehicle, vehicles with complex or irregular body shapes that will disturb the radiation pattern of the vehicle, and/or vehicles with trailers that will disturb the radiation pattern of the vehicle.

The invention teaches the use of a patch antenna, which provides a higher gain, further reach and a lower profile compared with a traditional rod antenna.

The inventive antenna design is compact and mechanically stable, it can be positioned close to metal behind the reflector, which makes it possible to install in many different positions on vehicles where other antenna designs will have problems with both environmental requirements and their radiation patterns.

The inventive antenna is easy to manufacture with high tolerances since punching of sheet metal or PCB are relatively inexpensive processes that can be done with high precision reproducibility.

BRIEF DESCRIPTION OF THE DRAWINGS

An antenna and an antenna system having the properties associated with the present invention will now be described in more detail for the purpose of exemplifying the invention, reference being made to the accompanying drawing, wherein:

FIG. 1*a* shows a top view of the vehicle and FIG. 1*b* shows a front view of the vehicle.

DETAILED DESCRIPTION

Figure 1A:
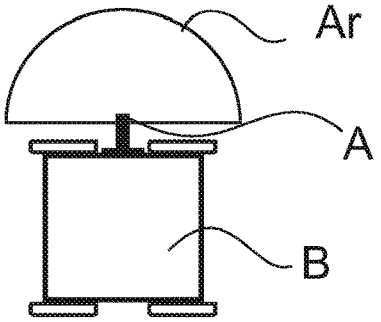
FIGS. 1*a* and 1*b* shows schematically and very simplified an antenna, its position on a vehicle, and the radiation pattern of the antenna positioned on the vehicle, where
Figure 1B:
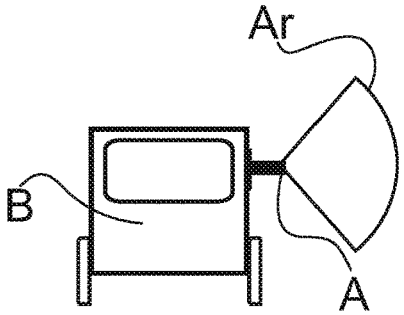

The present invention will be described with a reference to FIGS. 1*a* and 1*b* showing an antenna A for a vehicle B, where FIG. 1*a* is a top view of the vehicle and FIG. 1*b* is a front view of the vehicle. The antenna A has an omni-directional radiation pattern Ar and is adapted to V2X communication.

Figure 2:
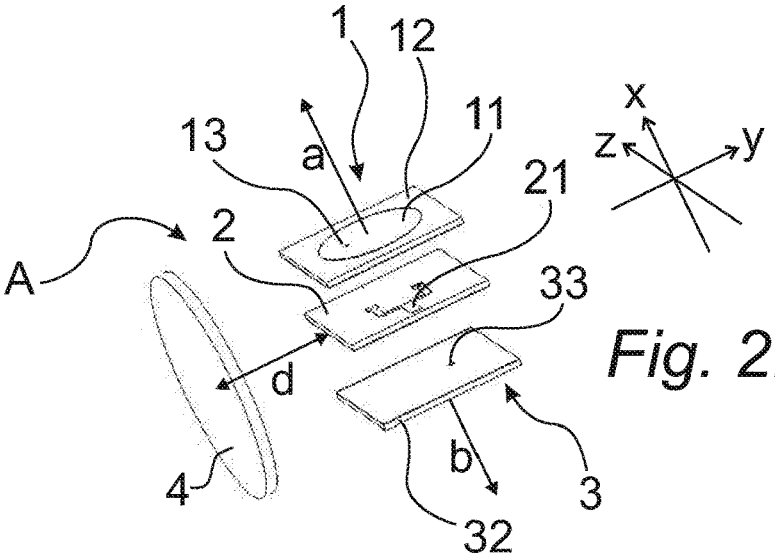
FIG. 2 shows an exploded view of an inventive antenna.

FIG. 2 shows an exploded view of the antenna A which comprises a first patch antenna 1, a feed network and power divider 21, a second patch antenna 3 and a reflector 4.

An x-y plane is defined as the horizontal plane in relation to the vehicle, an x-z plane is defined as a plane that is parallel to a side of the vehicle to which the antenna A is positioned, and an y-z plane is defined as an elevation plane in relation to the vehicle.

Figure 3A:
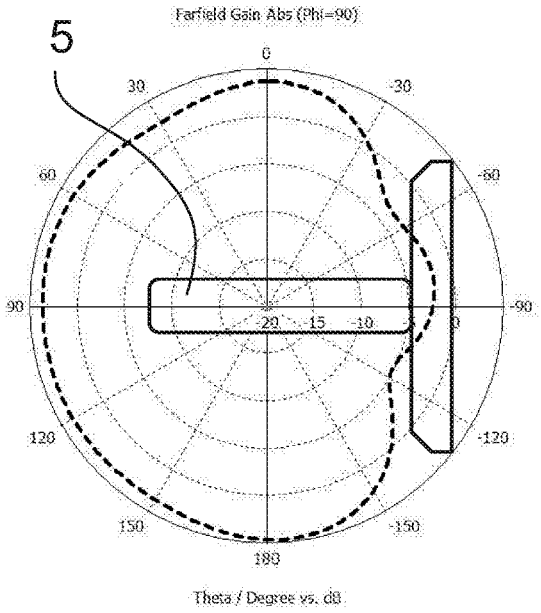
FIGS. 3*a* and 3*b* are graphs showing the radiation pattern of an inventive antenna.
Figure 3B:
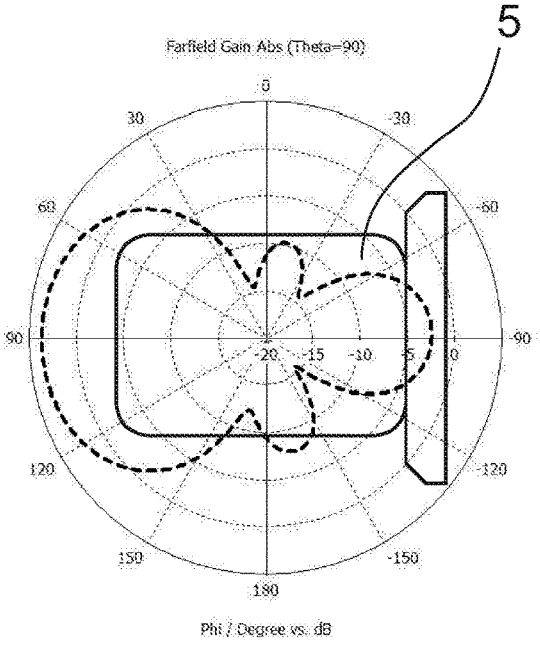

FIG. 2 shows that the first patch antenna 1 is aimed in a first direction along the x-axis, that the second patch antenna 3 is aimed in a second and opposite direction b along the x-axis, and that the reflector 4 is positioned in a plane that is parallel to the x-z plane, whereby the antenna A provides a radiation pattern of substantially a half circle in the horizontal plane, as schematically shown in FIG. 1*a* and as shown in FIG. 3*a*, and a radiation pattern of substantially a sector in the elevation plane, as schematically shown in FIG. 1*b* and as shown in FIG. 3*b*, of the vehicle B.

FIGS. 3*a* and 3*b* shows radiation patterns of an exemplified inventive antenna, where FIG. 3*a* is a graph showing a 2D cut in the horizontal plane of Fairfield Gain Abs (Phi=90) in the frequency of 5,8875 GHz and a main lobe magnitude of 4.4 dB, and where FIG. 3*b* is a graph showing a 2D cut in the vertical plane of Fairfield Gain Abs (Theta=90) in the frequency of 5,8875 GHz and a main lobe magnitude of 3.6 dB.

The reflector 4 is adapted to control the radiation pattern orientations for the first and second patch antenna 1, 3, and thus for the antenna A as a whole. It is proposed that the first and second patch antenna 1, 3 is a direct probe feed patch antenna.

A first electrically conductive structure can be used to form the patch antennas 1, 3 and a second electrically conductive structure can be used to form the feed network and power divider 21. The material for the first and second electrically conductive structure can be chosen independently from each other.

Examples of possible conductive structures are sheet metal and PCB. There are many other ways of forming a conductive structure, such as forming a structure through injection molding which is metalized to form desired conductive structure.

It is also possible that discrete components can be used to form the power divider regardless of what structure that is used to form the feed network.

For the sake of simplicity, a PCB 2 will be used in the following description to illustrate both the first and second electrically conductive structure. If the materials sheet metal and/or PCB are chosen, then it is clear that:

- sheet metal can be used for both the first and second electrically conductive structure,
- PCB can be used for both the first and second electrically conductive structure,
- sheet metal can be used for the first electrically conductive structure and PCB can be used for the second electrically conductive structure, or sheet metal can be used for the first electrically conductive structure and PCB can be used for the second electrically conductive structure.

Figure 4:
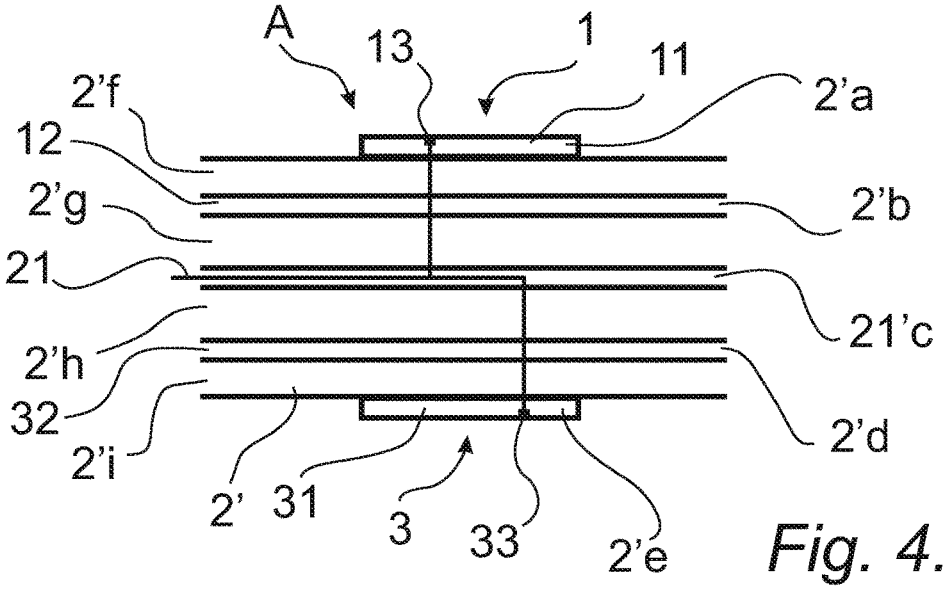
FIG. 4 shows a schematic and simplified side view of an antenna formed in a multi layered PCB.

FIG. 4 shows one proposed embodiment where an inventive antenna A is formed in a multi layered PCB 2', where:

- a first patch radiator 11 belonging to said first patch antenna 1 is formed in a first electrically conductive layer 2'*a* in said multi layered PCB 2',
- a first ground plane 12 belonging to said first patch antenna 1 is formed in a second electrically conductive layer 2'*b* in said multi layered PCB 2',
- said feed network and power divider 21 is formed in a third electrically conductive layer 2'*c* in said multi layered PCB 2',
- a second ground plane 32 belonging to said second patch antenna 3 is formed in a fourth electrically conductive layer 2'*d* in said multi layered PCB 2',
- a second patch radiator 31 belonging to said second patch antenna 3 is formed in a fifth electrically conductive layer 2'*e* in said multi layered PCB 2', and
- each electrically conductive layer 2'*a*, 2'*b*, 2'*c*, 2'*d*, 2'*e* is separated by a substrate layers 2'*f*, 2'*g*, 2'*h*, 2'*i* in said multi layered PCB 2'.

The antenna feed 13 from the feed network and power divider 21 is led

- from the feed network and power divider 21 in the third electrically conductive layer 2'*c* through the substrate layer 2'*g* separating the third electrically conductive layer 2'*c* from the second electrically conductive layer 2'*b*,
- through the first ground plane 12 in the second electrically conductive layer 2'*b*, and
- through the substrate layer 2'*f* separating the first electrically conductive layer 2'*a* from the second electrically conductive layer 2'*b*, and
- into contact with the first patch radiator 11 in the first electrically conductive layer 2'*a*.

In the same way, the other antenna feed 33 from the feed network and power divider 21 is led

- from the feed network and power divider 21 in the third electrically conductive layer 2'*c* through the substrate layer 2'*h* separating the third electrically conductive layer 2'*c* from the fourth electrically conductive layer 2'*d*,
- through the second ground plane 32 in the fourth electrically conductive layer 2'*d*, and
- through the substrate layer 2'*i* separating the fourth electrically conductive layer 2'*d* from the fifth electrically conductive layer 2'*e*, and
- into contact with the second patch radiator 31 in the fifth electrically conductive layer 2'*e*.

It should be understood that FIG. 4 shows only a schematic illustration of an inventive antenna and that the different thicknesses of the different electrically conductive layers and substrate layers are individually adapted to the antenna design of respective patch antenna and to the antenna as a whole in a real implementation of the invention.

As shown in FIGS. 2 and 3, the PCB 2 with its feed network 21 is positioned parallel to and between the first and second patch antenna 1, 3, and it is proposed that the power divider is a 3 dB in-phase micro strip power divider designed to combine the first and second patch antenna 1, 3.

A proposed embodiment of the present invention teaches that a low loss dielectric material with a thickness adapted to its DK value, such as Rogers RO4350 with DK=3,656, DF=0.0037 and thickness of 0.76 mm, is used as a substrate for the feed network and patch antennas 1, 3.

Proposed material properties are only one example of a PCB that can be used, where the thickness of 0.76 mm is a standard thickness for PCB, and it should be understood that a PCB with another thickness, DK and DF can be used.

The components of a patch antenna according to the present invention can be dimensioned and shaped in different ways. The distance and size of the reflector place a big role on the antenna radiation directivities. Which plane the reflector is placed, which in our case is the x-y plane, is also important, since the x-y plane define the horizon plane related to the antenna placed on the vehicle B. According to one exemplifying embodiment, where calculated dimensions are based on that the frequency to which the antenna is adapted is 5.8 GHz, it is proposed

- that the first and second patch antenna 1, 3 has a circular patch radiator 11 with a rectangular ground plane 12, 32,
- that the size of the ground plane 12, 32 is typically $\lambda/2\times\lambda/2\times0.76$ mm, which in this example would result in approximately 25 mm×25 mm×0.76 mm,
- that the metal reflector 4 has a diameter of typically 0.65 to 0.75λ, which would result in approximately 40 mm,
- that the reflector is positioned at a distance d of 0.3 to 0.4λ from the edge of the patch antennas 1, 3, which would result in approximately 20 mm,
- that the antenna feed 13 of the first patch antenna 1 is placed on the −y axis, and
- that the antenna feed 33 of the second patch antenna 3 is placed on the +y axis, in order to provide patch antennas in phase on the Phi=90 plane, and so that the reflector positioned in the x-z plane will not affect the phase.

It should be understood that illustrated embodiment is only an example of a possible antenna design. The shape of the patch, ground plane or reflector can be chosen differently from what is proposed in this embodiment, where these shapes can be circular, rectangular or oval depending on design, and the invention is not limited to shapes and dimensions shown in this proposed embodiment.

It is also proposed that the patch antenna 1, 3 has a feed structure such as a co-planar strip, proximity-coupled or aperture-coupled.

It is possible to use different ways of enhancing the capacity of the antenna, such as using an antenna array or a stacked patch antenna based on the inventive patch antenna.

With the purpose of eliminating any kind of mismatching and phase errors from the antenna it is proposed that parameters regarding design of the antenna, such as

- antenna feed probe location(s),
- divider dimensions,
- antenna distance to feed network locations,
- reflector size and distance to antenna element(s), are carefully designed.

The antenna can be designed and optimized to function for different frequency ranges and the exemplifying embodiment shows an antenna that is adapted to function in the frequency range of 5850 to 5925 MHz in order to match the antenna to the licensed ITS band of 5.9 GHz (5.85-5.925 GHz) according to the ITS-G5 standard. It is however obvious that the antenna design can be optimized for other systems and frequencies such 2.4 GHz or 5 GHz for WiFi, or 868/915 MHz.

Figure 5:
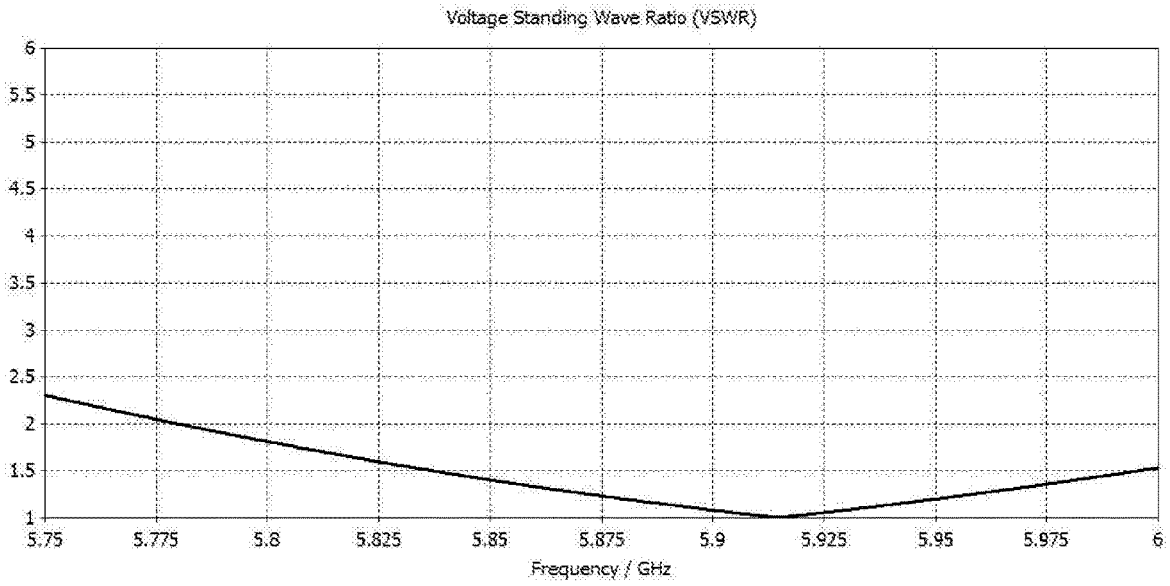
FIG. 5 is a graph showing the Voltage Standing Wave Ration of an inventive antenna.

It is also proposed that the antenna is adapted to provide an antenna gain in the range of 2 dBi to 5 dBi with an average of 3.5 dBi in the horizontal plane or bi-omni directions, and a Voltage Standing Wave Ratio (VSWR):

<2.0:1. FIG. 5 shows a graph of the antenna performance VSWR for an antenna according to this design.

The present invention also relates to an antenna system for a vehicle, which system is adapted to V2X communication. The system will be illustrated in FIG. 6, where it is shown that the system comprises at least one first antenna A1 and one second antenna A2 according to any exemplifying embodiment of the above mentioned inventive antenna A.

FIGS. 6 to 10 shows schematically the top view of a vehicle B where the direction of the vehicle B is indicated by an arrow on the vehicle.

Figure 6:
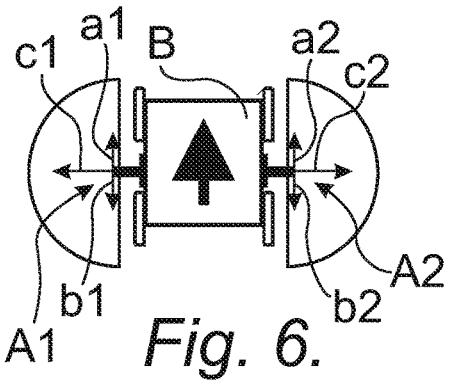
FIGS. 6 to 11 are schematic and simplified illustrations of different antenna systems where antennas are placed in different positions on a vehicle.

FIG. 6 illustrate that the first antenna A1 is positioned at an opposite position to the second antenna A2 on the vehicle B, that the y-axis of the first antenna A1 is directed in a first direction c1, and that the y-axis of the second antenna A2 is directed in a second direction c2 opposite to the first direction c1.

FIG. 6 illustrates an embodiment where the first and second antenna A1, A2 are positioned on the sides of the vehicle B, in which case the first direction a1 of the first patch antenna belonging to the first antenna A1 is the forward direction of the vehicle B, the second direction b1 of the second patch antenna belonging to the first antenna A1 is the backward direction of the vehicle B, and in which case the first direction a2 of the first patch antenna belonging to the second antenna A2 is the forward direction of the vehicle B, the second direction b2 of the second patch antenna belonging to the second antenna A2 is the backward direction of the vehicle B.

Figure 7:
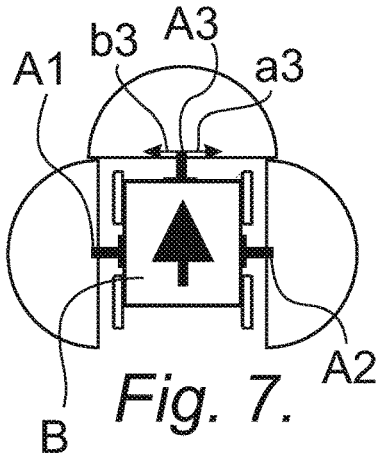

FIG. 7 illustrates a proposed embodiment showing that with antennas A1, A2 on the sides of the vehicle B it is also possible to include at least one third antenna A3 in the antenna system, which third antenna A3 is positioned in the front of the vehicle B, where the first direction a3 of the first patch antenna belonging to the third antenna A3 is the right direction of the vehicle B, and the second direction d3 of the second patch antenna belonging to the third antenna A3 is the left direction of the vehicle B.

Figure 8:
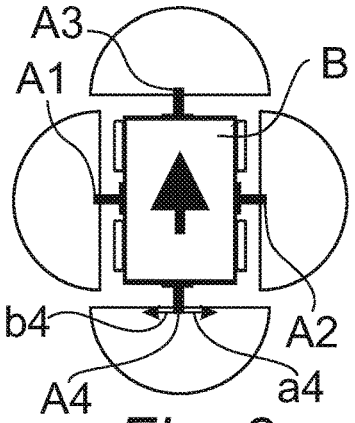

FIG. 8 shows that in the same way it is also possible to have at least one fourth antenna A4, which is positioned in the back of the vehicle B, where the first direction a4 of the first patch antenna belonging to the fourth antenna A4 is the right direction of the vehicle B, and that the second direction b4 of the second patch antenna belonging to the fourth antenna A4 is the left direction of the vehicle B. These first, second, third and fourth antennas A1, A2, A3, A4 will provide a possibility to have a system radiation pattern that covers the full 360 degrees around the vehicle, even with vehicles of very complex shape and form.

Figure 9:
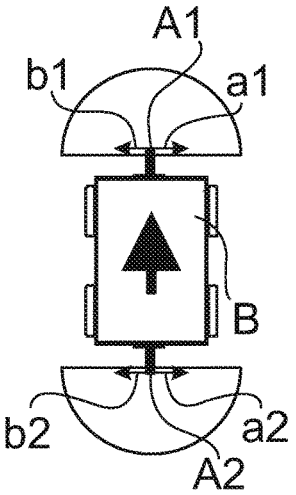

FIG. 9 illustrates a possible embodiment with only two antennas A1, A2, where a first antenna A1 is positioned in the front of the vehicle B and the second antenna A2 is positioned in the back of the vehicle B, in which case the first direction a1 of the first patch antenna belonging to the first antenna A1 is the right direction of the vehicle B, the second direction b1 of the second patch antenna belonging to the first antenna A1 is the left direction of the vehicle B, and in which case the first direction a2 of the first patch antenna belonging to the second antenna A2 is the right direction of the vehicle B, the second direction b2 of the second patch antenna belonging to the second antenna A2 is the left direction of the vehicle B.

Figure 10:
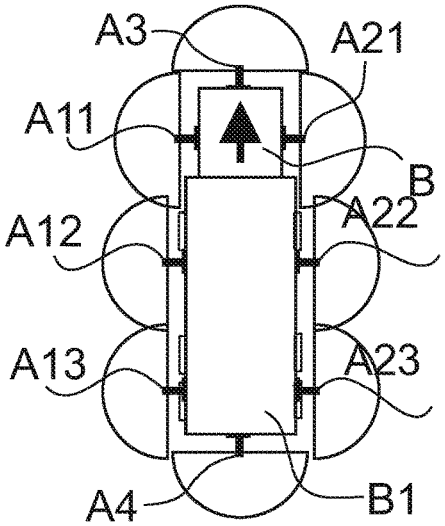

FIG. 10 illustrate a proposed embodiment where several antennas have been positioned on a vehicle B and a trailer B1 belonging to the vehicle. A trailer or something else connected to the vehicle B, will provide possibilities to position antennas on other places than the actual vehicle itself. Here it can be seen that the vehicle B has three antennas, A11, A21 and A3, while the trailer B1 has 5 antennas A12, A13, A22, A23 and A4 in different directions around the trailer B1. Antennas positioned on a trailer can be connected to the vehicle through any connection device that provides signal transmission between the vehicle B and the trailer B1.

Figure 11:
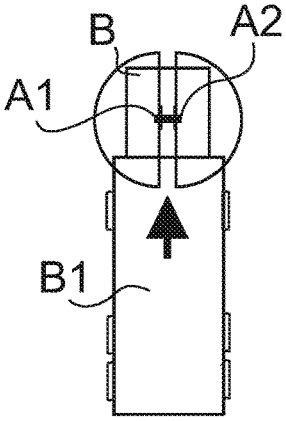

FIG. 11 shows an alternative embodiment where a first antenna A1 and a second antenna A2 have been positioned on top of a vehicle B. In FIG. 11 the direction of the vehicle B is indicated by an arrow on the vehicle trailer B1 behind the vehicle B. One of the problems that is solved by the present invention is to provide an antenna on a vehicle where it is not possible to place the antenna on top of the vehicle. The present invention provides an antenna that will solve this problem. However, this does not prevent that an inventive antenna can be positioned on top of a vehicle when this position is possible and available, as illustrated in FIG. 11.

Figure 12:
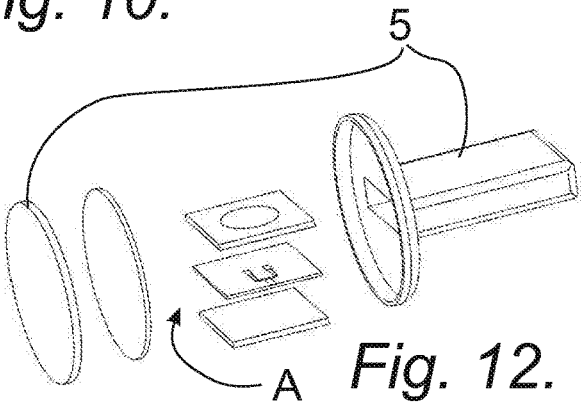
FIG. 12 is an exploded view of an antenna with a radome.

FIG. 12 shows that the antenna system may provide mechanical and environmental protection to an antenna A through a radome 5 for each antenna that require such protection to protect and enclose such antenna, which radome 5 also is shown in FIGS. 3*a* and 3*b*.

Each antenna in the system require a clear light-of-sight from the vehicle to other objects or vehicles around the vehicle. This can be achieved if it is possible to position the antenna on parts of the vehicle that extends out from the vehicle, such as a rear view mirror on the vehicle or if possible on top of the vehicle.

Figure 13:
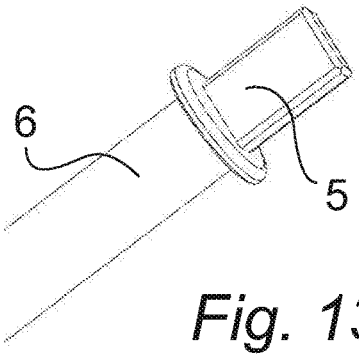
FIG. 13 is an illustration of an antenna in its radome positioned on a mechanical support.

There might be situations where there are no such parts on the vehicle, and FIG. 13 shows an embodiment where the antenna system comprises mechanical support 6 for an antenna, which mechanical support extends from the vehicle to position the supported antenna in a position with clear light-of-sight from the vehicle to other objects or vehicles around the vehicle.

The length extension of a support 6 varies depending on how far out from the vehicle the antenna needs to be positioned, and some antennas in the system might not require any such support but can be mounted directly on the vehicle.

The skilled person understand that antennas according to the invention can be combined into an antenna system according to the invention in many different ways, where proposed embodiments discloses some of these possible antenna configurations, thus it is clear that the invention is not limited to the embodiments given above as examples but may be subjected to modifications within the scope of the general idea of to the invention as defined and shown in the subsequent claims.

The invention claimed is:

1. An antenna for a vehicle, the antenna having an omni-directional radiation pattern and being configured for V2X communication, an x-y plane being defined as the horizontal plane in relation to the vehicle, an x-z plane being defined as a plane that is parallel to a side of the vehicle to which the antenna is positioned, a y-z plane being defined as an elevation plane in relation to the vehicle, the antenna comprising:

a first patch antenna, the first patch antenna being aimed in a first direction along the x-axis;

a feed network and power divider; and a second patch antenna and a reflector, the second patch antenna being aimed in a second and opposite direction along the x-axis, and the reflector being positioned in a plane that is parallel to the x-z plane.

2. The antenna according to claim 1, wherein the reflector is configured to control the radiation pattern orientations for the first and second patch antenna, and thus for the antenna as a whole.

3. The antenna according to claim 1, wherein the first and second patch antenna is a direct probe feed patch antenna.

4. The antenna according to claim 1, wherein a first electrically conductive structure is used to form the patch antennas and wherein a second electrically conductive structure is used to form the feed network and power divider.

5. The antenna according to claim 4, wherein at least one of the first and the second electrically conductive structure is a sheet metal.

6. The antenna according to claim 4, wherein at least one of the first and the second electrically conductive structure is a printed circuit board (PCB).

7. The antenna according to claim 6, wherein the antenna is formed in a multi layered PCB, wherein:

a first patch radiator belonging to the first patch antenna is formed in a first electrically conductive layer in the multi layered PCB;

a first ground plane belonging to the first patch antenna is formed in a second electrically conductive layer in the multi layered PCB;

the feed network and power divider is formed in a third electrically conductive layer in the multi layered PCB;

a second ground plane belonging to the second patch antenna is formed in a fourth electrically conductive layer in the multi layered PCB;

a second patch radiator belonging to the second patch antenna is formed in a fifth electrically conductive layer in the multi layered PCB; and each electrically conductive layer is separated by a substrate in the multi layered PCB.

8. The antenna according to claim 4, wherein the second electrically conductive structure with the feed network is positioned parallel to and between the first and second patch antenna, and wherein the power divider is a 3 dB in-phase microstrip power divider configured to combine the first and second patch antenna.

9. The antenna according to claim 8, wherein a low loss dielectric material with a thickness adapted to its DK value is used as a substrate for at least one of the feed network and the patch antennas.

10. The antenna according to claim 1, wherein a first electrically conductive structure is used to form the patch antennas, wherein a second electrically conductive structure is used to form the feed network, and wherein discrete components are used to form the power divider.

11. The antenna according to claim 1, wherein:

the first and second patch antenna has a circular patch radiator with a rectangular ground plane;

the size of the ground plane is substantially $\lambda/2\times\lambda/2\times0.76$ mm;

the metal reflector has a diameter of substantially 0.65 to substantially $0.75\lambda$;

the reflector is positioned at a distance of 0.3 to $0.4\lambda$ from the edge of the first and second patch antenna;

the antenna feed of the first patch antenna is placed on the −y axis; and the antenna feed of the second patch antenna is placed on the +y axis.

12. The antenna according to claim 1, wherein the patch antenna has a feed structure, the feed structure being one of a co-planar strip, proximity-coupled and aperture-coupled.

13. The antenna according to claim 1, wherein the patch antenna is one of an antenna array and a stacked patch antenna.

14. The antenna according to claim 1, wherein parameters regarding design of the antenna, including at least of:

antenna feed probe location(s);

divider dimensions;

antenna distance to feed network locations; and reflector size and distance to antenna element(s);

are selected to eliminate mismatching and phase errors.

15. The antenna according to claim 1, wherein the antenna is configured to function in the frequency range of 5850 to 5925 MHz.

16. The antenna according to claim 1, wherein the antenna is configured to provide an antenna gain in the range of 2 dBi to 5 dBi with an average of 3.5 dBi in the horizontal plane and VSWR: <2.0:1.

17. An antenna system for a vehicle, the system being configured for V2X communication, the antenna system comprising at least one first and one second antenna, each of the at least one first and one second antenna having:

an omni-directional radiation pattern and being configured for V2X communication, an x-y plane being defined as the horizontal plane in relation to the vehicle, an x-z plane being defined as a plane that is parallel to a side of the vehicle to which the antenna is positioned, a y-z plane being defined as an elevation plane in relation to the vehicle, the antenna comprising:

a first patch antenna, the first patch antenna being aimed in a first direction along the x-axis;

a feed network and power divider; and a second patch antenna and a reflector, the second patch antenna being aimed in a second and opposite direction along the x-axis, and the reflector being positioned in a plane that is parallel to the x-z plane; and the first antenna being positioned at an opposite position to the second antenna on the vehicle, the y-axis of the first antenna being directed in a first direction, and the y-axis of the second antenna being directed in a second direction opposite to the first direction.

18. The antenna system according to claim 17, wherein the first and second antennas are positioned on the sides of the vehicle, wherein the first direction of respective first patch antenna is the forward direction of the vehicle, and wherein the second direction of respective second patch antenna is the backward direction of the vehicle.

19. The antenna system according to claim 18, wherein the antenna system comprises at least one third antenna, wherein the third antenna is positioned in the front of the vehicle, wherein the first direction of the first patch antenna belonging to the third antenna is the right direction of the vehicle, and wherein the second direction of the second patch antenna belonging to the third antenna is the left direction of the vehicle.

20. The antenna system according to claim 18, wherein the antenna system comprises at least one fourth antenna, wherein the fourth antenna is positioned in the back of the vehicle, wherein the first direction of the first patch antenna belonging to the fourth antenna is the right direction of the vehicle, and wherein the second direction of the second patch antenna belonging to the fourth antenna is the left direction of the vehicle.

21. The antenna system according to claim 17, wherein the first and second antennas are positioned in the front and back of the vehicle, wherein the first direction of respective first patch antenna is the right direction of the vehicle, and wherein the second direction of respective second patch antenna is the left direction of the vehicle.

22. The antenna system according to claim 17, wherein the antenna system comprises mechanical support for at least one antenna, and wherein the mechanical support extends from the vehicle to position the supported antenna to provide clear light-of-sight from the vehicle to other objects or vehicles around the vehicle.

23. The antenna system according to claim 17, wherein the antenna system comprises a radome for at least one antenna configured to protect and enclose the at least one antenna.

* * * * *